US006776136B1

(12) United States Patent
Kazempour

(10) Patent No.: US 6,776,136 B1
(45) Date of Patent: Aug. 17, 2004

(54) ELLIPTICAL ROTARY ENGINE

(76) Inventor: Shahroukh M Kazempour, 14429 8th Ave. Southwest, #2, Burien, WA (US) 98166

( * ) Notice: Subject to any disclaimer, the term of this patent is extended or adjusted under 35 U.S.C. 154(b) by 0 days.

(21) Appl. No.: 10/403,890

(22) Filed: Mar. 31, 2003

(51) Int. Cl.[7] ..... F02B 53/00
(52) U.S. Cl. ..... 123/243; 418/92; 418/147
(58) Field of Search ..... 123/243, 246, 123/227; 418/92, 147, 83, 93, 94, 260

(56) References Cited

U.S. PATENT DOCUMENTS 1,811,729 A * 6/1931 Molkenbur ..... 418/92
3,452,724 A * 7/1969 Marszal ..... 418/92
3,727,589 A * 4/1973 Scott ..... 418/147
3,863,611 A * 2/1975 Bakos ..... 418/92
5,509,793 A * 4/1996 Cherry et al. ..... 123/243
5,634,783 A * 6/1997 Beal ..... 418/92

FOREIGN PATENT DOCUMENTS

DE 3310196 A * 2/1984 ..... 418/147
GB 2218469 A * 11/1989 ..... 418/147

* cited by examiner

*Primary Examiner*—Thomas Denion
*Assistant Examiner*—Thai-Ba Trieu
(74) *Attorney, Agent, or Firm*—Michael I Kroll

(57) ABSTRACT

An elliptical potary engine having a cylindrical rotor that rotates within a cyclindrical housing having cycling chambers defined between a plurality of radially extending piston vanes disposed within vane channels within the rotor. During the rotation of the rotor, the piston vanes are urged radially outward by cam-like elliptical piston vane guides associated with the head and the base of the housing and are returned therein by the elliptical interior wall as the diameter thereof decreases.

9 Claims, 14 Drawing Sheets

ELLIPTICAL ROTARY ENGINE

BACKGROUND OF THE INVENTION

1. Field of the Invention

The present invention relates generally to rotary engines and, more specifically, to an elliptical rotary engine having a substantially cylindrical rotor element that rotates within an elliptical housing. A plurality of piston vanes reciprocate within and partially extend beyond piston channels in the rotor element and are urged toward the interior wall of the elliptical housing by pressurized oil introduced into the piston channel. Convex apex seals extend along the length of the distal ends of the piston vanes and rotate slightly as the engine passes through its cycle in order to conform to the curvature of the housing to provide a reliable seal therebetween. Oil conduits traverse the piston vanes to transfer pressurized oil to the apex seals with the directional flow of oil therethrough regulated by one-way check valves installed therein. The apex seals have conically shaped recesses extending therethrough with the tapered ends providing narrower recesses at the surface in contact with the housing wall in order to provide a constant supply of oil to pass therethough for the lubrication of the frictionally mated surfaces. A serpentine coolant channel extends through the housing base, block and head to maintain proper thermal control of the unit.

2. Description of the Prior Art

There are other headband devices designed for securing a communication device. Typical of these is U.S. Pat. No. 2,263,275 issued to G. F. Pieper on Nov. 18, 1941.

Another patent was issued to F. E. Heydrich on May 10, 1966 as U.S. Pat. No. 3,250,260. Yet another U.S. Pat. No. 3,437,079 was issued to D. Odawara on Apr. 8, 1969 and still yet another was issued on Oct. 2, 1973 to A. P. Bentley as U.S. Pat. No. 3,762,375.

Another patent was issued to L. D. Chisolm on Dec. 30, 1975 as U.S. Pat. No. 3,929,105. Yet another U.S. Pat. No. 4,018,191 was issued to L. B. Lloyd on Apr. 19, 1977. Another was issued to O. E. Rosaen on Oct. 12, 1982 as U.S. Pat. No. 4,353,337 and still yet another was issued on May 26, 1987 to C. N. Hansen as U.S. Pat. No. 4,667,468.

Another patent was issued to J. L. McCann on May 16, 1995 as U.S. Pat. No. 5,415,141. Yet another U.S. Pat. No. 5,524,587 was issued to Mallen et al on Jun 11, 1996. Another was issued to Holdampf on Jan. 27, 1998 as U.S. Pat. No. 5,711,268.

U.S. Pat. No. 2,263,275

Inventor: George F. Pieper

Issued: Nov. 18, 1941

In a rotary diesel internal combustion engine, a stator having a firing chamber therein and a chamber located in advance of the firing chamber, each of said chambers being provided with a cam face, a rotor snugly fitted in said stator provided with equidistantly spaced cylinders, removable cylinder liners fitted in said cylinders, removable cylinder heads carried by the rotor closing the cylinders and holding the liners in place, pistons reciprocally mounted in the cylinder liners, rigid vanes carried by the pistons slidable through the cylinder heads, means for supplying air from the exterior of the engine to the inner ends of the cylinder at certain times, means for controlling the flow of air from the cylinders to the combustion chamber, and spring means normally urging the vanes and pistons outwardly, the vanes and pistons being adapted to be cammed inwardly by the cam faces of the stator chambers.

U.S. Pat. No. 3,250,260

Inventor: Fred E. Heydrich

Issued: May 10, 1966

A rotary sliding vane engine having an engine housing with a peripheral wall having a symmetrical elliptical shaped inner surface and a pair of axially spaced end walls, a rotor mounted for rotation about a fixed axis at the intersection of the major and minor axes of said elliptical surface, said rotor having a pair of axially spaced end flanges of greater diameter than the major diameter of said elliptical surface and a hollow drum intermediate and fixed to said end flanges, axially extending slots in said drum, radially extending grooves in said end flanges aligned with said slots, with the ends of said vanes extending into said grooves in said end flanges, axially extending slots in said drum, radially extending grooves in said end flanges aligned with said slots, sliding vanes carried by said rotor in said slots, with the ends of said vanes extending into said grooves in said end flanges, said vanes cooperating with the inner housing surface to form a plurality of expansible chambers, means in said housing on opposite sides of one end of said minor axis communicating with said expansible chambers to supply combustible mixture to, and exhaust combustion products from said expansible chambers, axle means journalled in said engine housing and extending along rotor, said rotor axis and attached to said one end of said axle ending at the engine housing outer surface and being hollow and communicating with the inside of said drum to form an axial air intake, means on said housing for securing a carburetor to said air intake, radially arranged passages in one of said end flanges, passage means communicating said radial passages to the hollow interior of said drum, the radially outer ends of said radial passages opening to a fluid receiving chamber in said engine housing, means communicating said said fluid receiving chamber to said supply means, impeller means mounted on the face of the other of said end flanges remote from said hollow drum, means in said engine housing adjacent said impeller forming a chamber for receiving fluid from said impeller, and passages in said peripheral wall for directing fluid from said impeller fluid receiving chamber to cool said housing wall, and ignition means adjacent said other end of said minor axis on the some side as said exhaust means and communicating with said expansible chambers as they move past said ignition.

U.S. Pat. No. 3,437,079

Inventor: Daisaku Odawara

Issued: Apr. 8, 1969

A rotary machine of the blade type includes a plurality of blades mounted on a rotor which is eccentrically and rotatably mounted in a stationary outer casing, and working chambers which undergo periodic changes in volume as the rotor rotates. An air-tight rotor has a circumferential wall extending around the radially outer ends of the blades, and this air-tight rotor is rotatably mounted in and concentric with the outer casing, anti-friction means being disposed between the air-tight rotor and the outer casing. The radially outer ends of the blades maintain close contact with the circumfertial wall of the air-tight rotor, and the latter has at least one diametrically extending side wall engaged with the rotor which mounts the blades, the air-tight rotor and the outer casing.

U.S. Pat. No. 3,762,375

Inventor: Arthur P. Bentley

Issued: Oct. 2, 1973

This specification discloses a rotary internal vane combustion engine comprising a casing defining a rotor chamber of a shape resembling an ellipse. A shaft is journalled in the casing centrally thereof and driveably mounted on the shaft is a rotor presenting a cylindrical surface. The rotor is formed with a plurality of radial slots and slideably in each slot is a vane. The rotor is also formed with a plurality of combustion chambers opening onto its cylindrical surface. The number of combustion chambers is the same as the numbers of slots with a chamber being located between two adjacent slots.

An intake port for an air, gas, oil mixture is formed in the casing and communicating with this port are a pair of channels formed in the casing on opposite sides of the rotor chamber. These channels pass about the shaft where it is journalled in the casing and open onto the rotor chamber at points diametrically opposed to the intake port. A manifold type exhaust is formed in the casing about 30 degrees from the intake port.

A spark plug is mounted on the casing with its points located at the periphery of the rotor chamber. Conductors extend from the spark plug to contact mounted on the exterior of the casing with the contacts being bridged at periodic intervals by a cam driveably mounted on the shaft. The shaft also driveably carries a gear with which meshes a pinion that is driven by a starting motor.

U.S. Pat. No. 3,929,105

Inventor: Lloyd Duncan Chisholm

Issued: Dec. 30, 1975

Rotary internal combustion engine having five distinct phases of operation comprising an air-charge intake phase, a compression phase, expansion phase and exhaust phase. The engine comprises a stator with an undulating working fluid surface and a cooperating vaned rotor wherein the vanes form rotating pockets or chambers of the working fluid through each distinct phase during one revolution of the rotor. The combustion phase takes place at substantially constant volume and is of such a duration to achieve substantially complete combustion.

U.S. Pat. No. 4,018,191

Inventor: L. Babcock Lloyd

Issued: Apr. 19, 1977

A rotary internal combustion engine that includes a housing that defines an elliptical cavity in which a rotor is disposed. The rotor slidably supports a number of circumferentially spaced, radially disposed blades, with each pair of blades defining a chamber therebetween. The rotor is so rotatably supported in the cavity that the ratio of the intake chamber volume may be adjusted so that there is a minimum residual pressure on exhaust gases and the efficiency of the engine is increased as a result thereof.

U.S. Pat. No. 4,353,337

Inventor: Oscar E. Rosaen

Issued: Oct. 12, 1982

A rotary internal combustion engine having an elliptical wall member which forms an elliptical internal chamber. A drive shaft is rotatably mounted in the housing and extends transversely through the elliptical chamber. A substantially cylindrical rotor is secured to the drive shaft within the chamber and has a plurality of circumferentially equidistantly spaced vane members radially slidably disposed within the rotor. A source of fluid pressure communicates with the radially inner end of the vane members to urge the vane members radially outwardly so that the vane members contact the elliptical wall. Moreover, each vane member is of a sliding laminated construction to ensure a sealing engagement between the vane member and the wall surface. A fuel and air mixture is supplied to the rotor via an air suction chamber which thereafter is compressed with the fuel between the rotor, the wall portion and adjacent vane members. The fuel/air mixture is ignited by appropriate ignition means to thereby rotatably drive the drive shaft. At at least one rotational position for each combustion cycle two vane members separate the combustion chamber from both the suction and the exhaust chambers to ensure that at least one vane member always separates the combustion chamber from both the suction and exhaust chambers. In addition, a fuel enrichment device utilizes a portion of the compressed fuel/air mixture to selectively augment the fuel supply to the engine.

U.S. Pat. No. 4,667,468

Inventor: Craig N. Hansen

Issued: May 26, 1987

A rotary internal combustion engine has a housing with an elliptical inside surface surrounding an elliptical rotor forming with the housing combustion chambers. Valve and ignition assemblies connected to a source of air under pressure and injectors for introducing fuel into the air supply sequentially allows the air and fuel mixture to flow into the combustion chambers and ignite the air and fuel mixture therein. Vane and seal assemblies on the rotor and housing are controlled with cam and linkages to provide positive effective gas seals between the housing and rotor. A slack adjuster maintains lateral sealing relationships between the housing vane and seal assemblies and opposite side walls of the housing.

U.S. Pat. No. 5,415,141

Inventor: James L. McCann

Issued: May 16, 1995

A rotary device has a stator having a space therein with an oval peripheral wall. A rotor is rotatably mounted within the space. The rotor has a circular outer wall. There are two chambers on opposite sides of the stator between the peripheral wall and the outer wall of the rotor. Vanes are reciprocatingly mounted on the rotor for radial movement towards and away from the rotor. Each vane has an outer wall. There is a cam mechanism for maintaining the outer walls of the vanes in contact with the peripheral wall of the stator as the rotor rotates.

U.S. Pat. No. 5,524,587

Inventor: Brian D. Mallen et al.

Issued: Jun. 11, 1996

A sliding vane engine, where the vanes slide with at least of one of an axial and radial component of vane motion, and where the compression ratio of the engine may be variably controlled. The engine includes a stator and a rotor in relative rotation, and a plurality of vanes in rotor slits defining one or more main chamber cells and one or more vane slit cells. The vanes contain extended pins that move in a pin channel for controlling the sliding motion of the vane. Fuel is mixed by incorporating air turbulence generators at or near the intake region. The intake and exhaust regions of the engine also incorporate a wave pumping mechanism for injecting and scavenging air from the main chamber cells and the vane slits. The compression ratio of the engine may be varied while the engine is in operation, and the engine geometry provides for an extended temporal duration at about peak compression. The engine is insulated by using segmented ceramic inserts on the stator and rotor surfaces.

U.S. Pat. No. 5,711,268

Inventor: Carl J. Holdampf

Issued: Jan. 27, 1998

A rotary vane internal combustion engine wherein the section of the rotor housing where ignition takes place is formed in the shape of a circular arc matching the curvature of the rotor, with the balance of the housing periphery being composed of a series of tangent arcs to define an elliptical shape that is continuously concave and has no drastic changes in curvature. The rotor and housing are "stretched" along their axial dimensions so that each combustion chamber has an axial measurement substantially greater than its circumferential measurement, and each segment of the rotor surface between adjacent vanes has formed therein a plurality of combustion chamber pockets spaced from one another along the axial dimension of the rotor and each provided with a spark plug. Circumferentially separated and separately throttled primary and secondary intake ports are provided to reduce intake throttle losses at low engine loads, and exhaust ports are provided which extend along the axial length of the rotor housing to avoid localized heating of the vane tips. The vanes are of a novel multi-layer construction with spring loaded seals along their lines of contact with the stationary engine parts, thereby minimizing intra-chamber pressure leakage.

While these rotary engine devices may be suitable for the purposes for which they were designed, they would not be as suitable for the purposes of the present invention, as hereinafter described.

SUMMARY OF THE PRESENT INVENTION

A primary object of the present invention is to provide an elliptical rotary engine that will provide higher efficiency, greater power output and higher RPM and torque than conventional engines.

Another object of the present invention is to provide an elliptical rotary engine with fewer movable parts that are susceptible to degradation than conventional engines.

Yet another object of the present invention is to provide an elliptical rotary engine having minimal maintenance and repair requirements.

Still yet another object of the present invention is to provide an elliptical rotary engine wherein fuel intake and exhaust occur simultaneously.

Another object of the present invention is to provide an elliptical rotary engine that may be adapted for operation with various fuel types including gasoline, diesel and alcohol-based fuels.

Yet another object of the present invention is to provide an elliptical rotary engine with enhanced cooling and lubrication capabilities.

Still yet another object of the present invention is to provide an elliptical rotary engine that is simple and easy to use.

One other object of the present invention is to provide an elliptical rotary engine that is inexpensive to manufacture and operate.

Additional objects of the present invention will appear as the description proceeds.

The present invention overcomes the shortcomings of the prior art by providing an elliptical rotary engine having a substantially cylindrical rotor element that rotates within an elliptical housing. A plurality of piston vanes reciprocate within and partially extend beyond piston channels in the rotor element and are urged toward the interior wall of the elliptical housing by pressurized oil introduced into the piston channel. Convex apex seals extend along the length of the distal ends of the piston vanes and rotate slightly as the engine passes through its cycle in order to conform to the curvature of the housing to provide a reliable seal therebetween. Oil conduits traverse the piston vanes to transfer pressurized oil to the apex seals with the directional flow of oil therethrough regulated by one-way check valves installed therein. The apex seals have conically shaped recesses extending therethrough with the tapered ends providing narrower recesses at the surface in contact with the housing wall in order to provide a constant supply of oil to pass therethough for the lubrication of the frictionally mated surfaces. A serpentine coolant channel extends through the housing base, block and head to maintain proper thermal control of the unit.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

Figure 11:
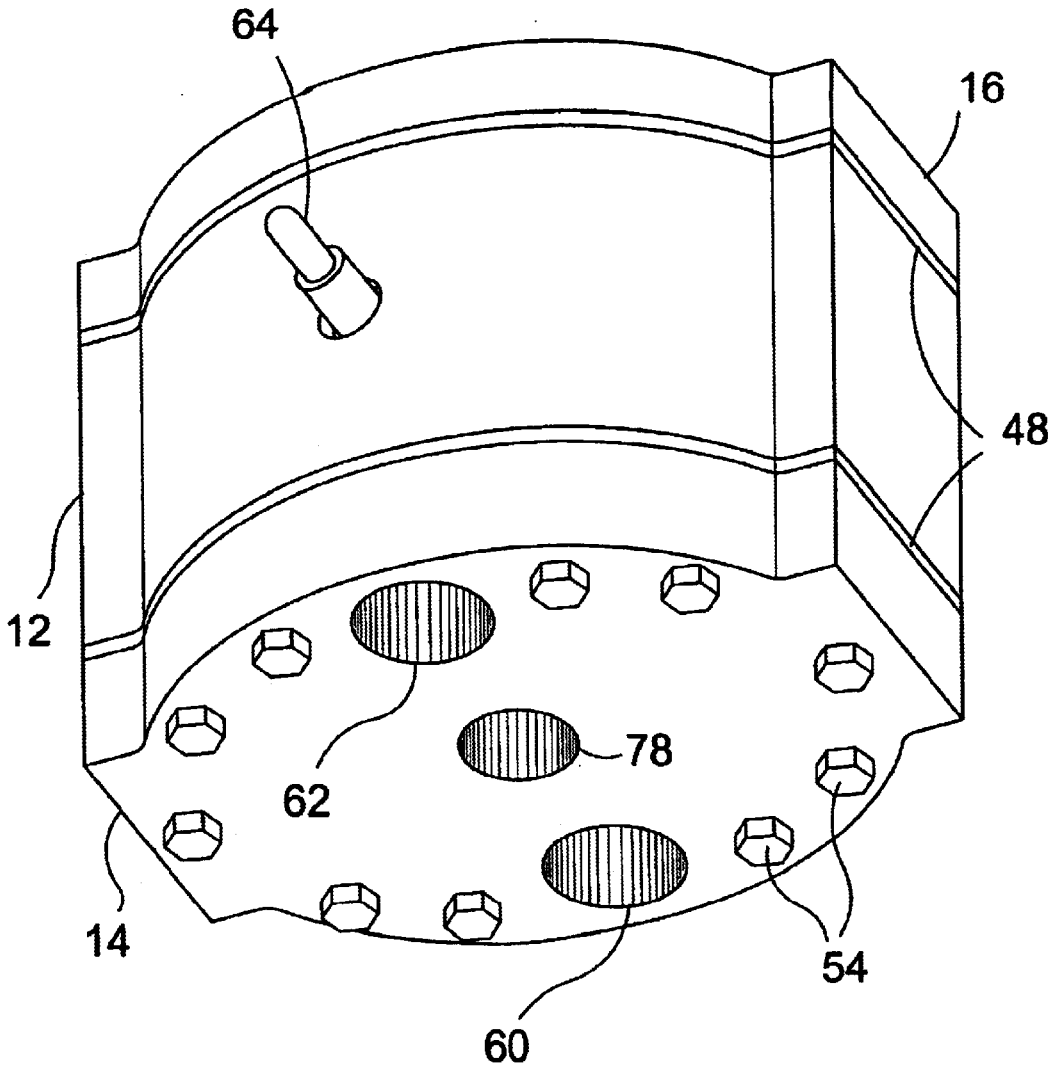
Figure 12:
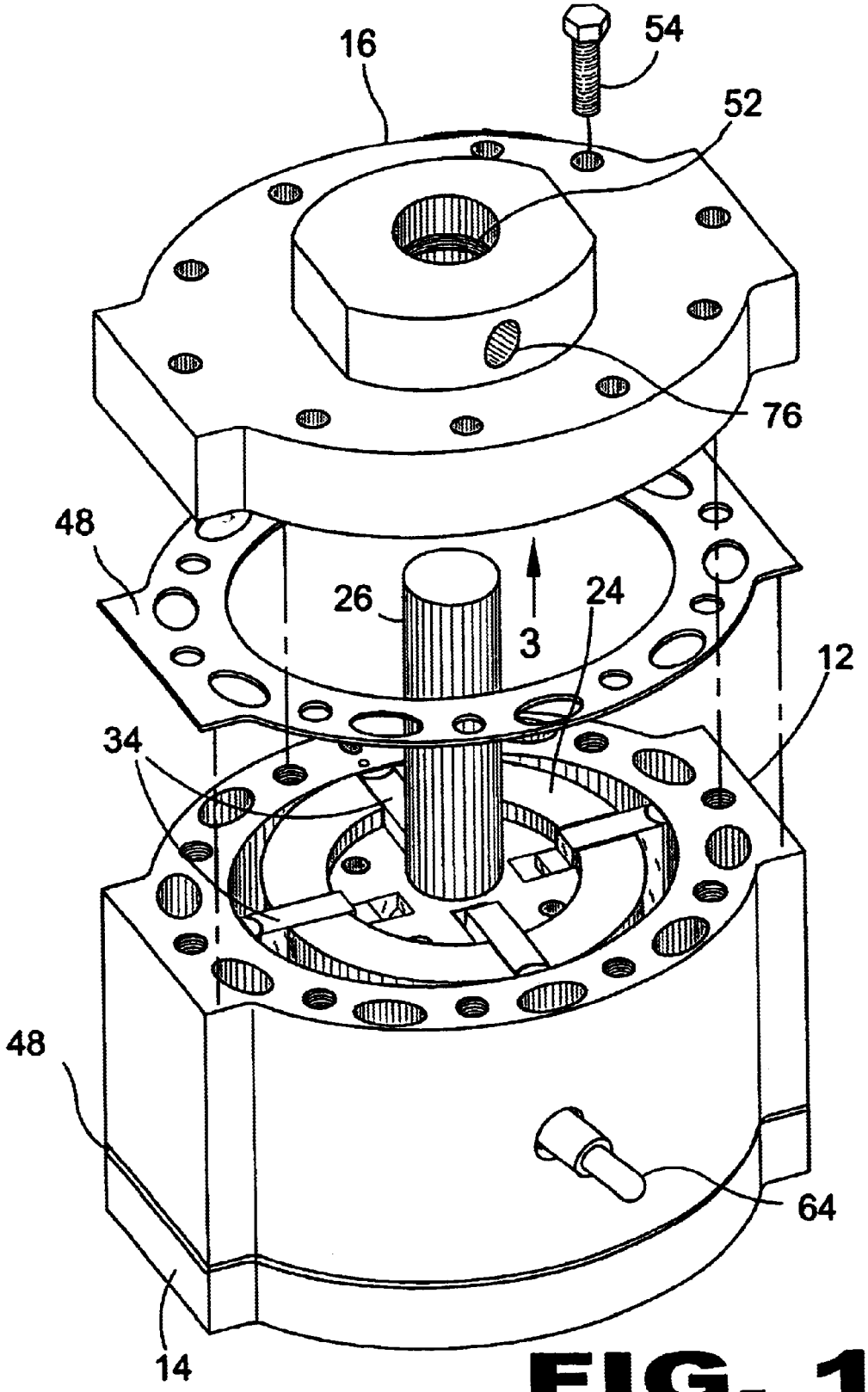
Figure 13:
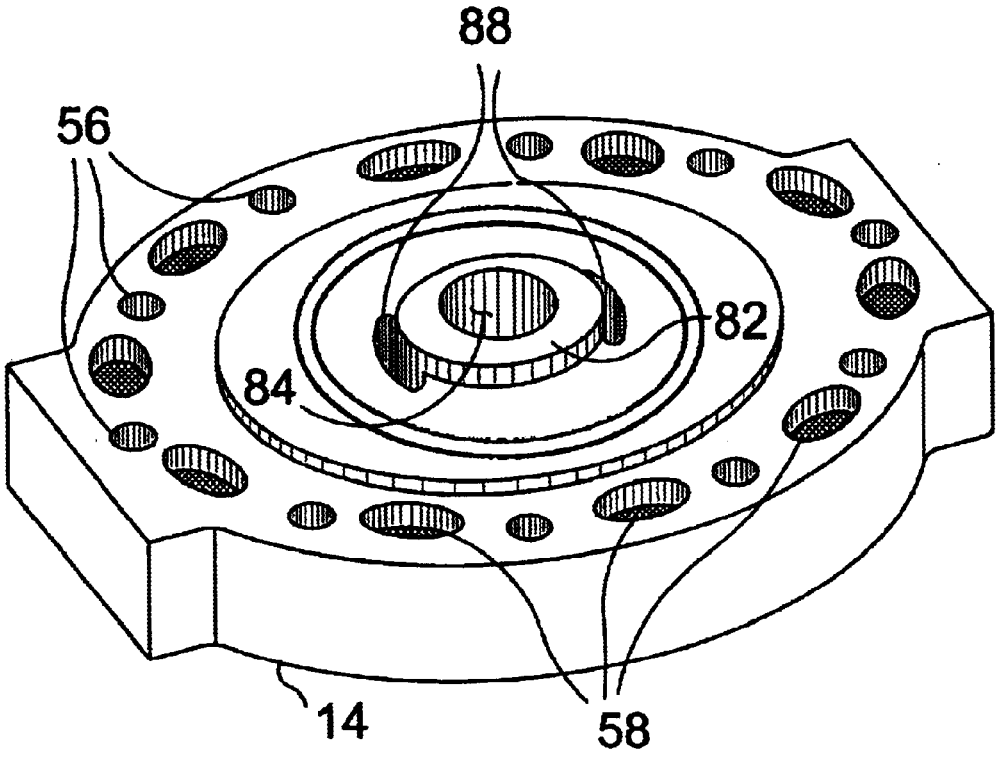

FIG. 11 a bottom perspective view of the present invention;

FIG. 12 is a rear partially exploded view of the present invention;

FIG. 13 is a rear perspective view of the housing base; and

Figure 14:
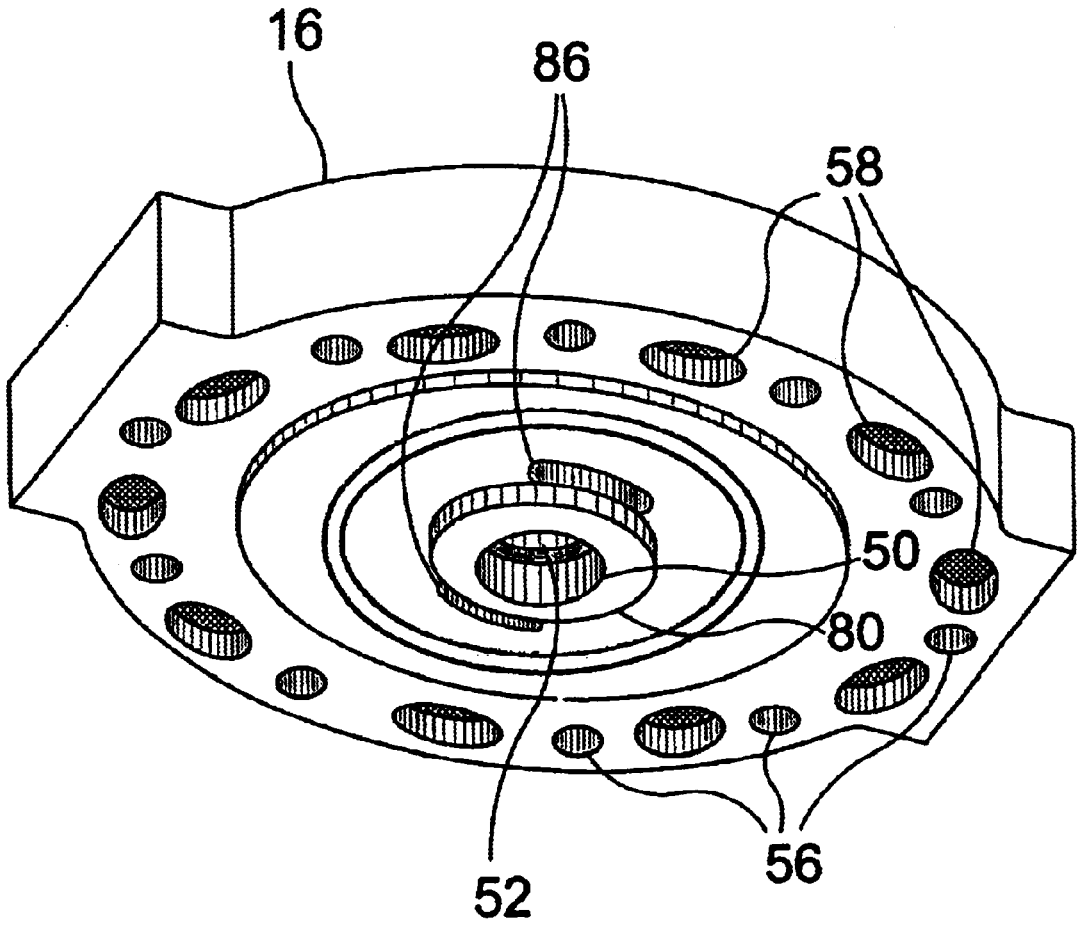

FIG. 14 is a bottom perspective view of the housing head.

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Figure 1:
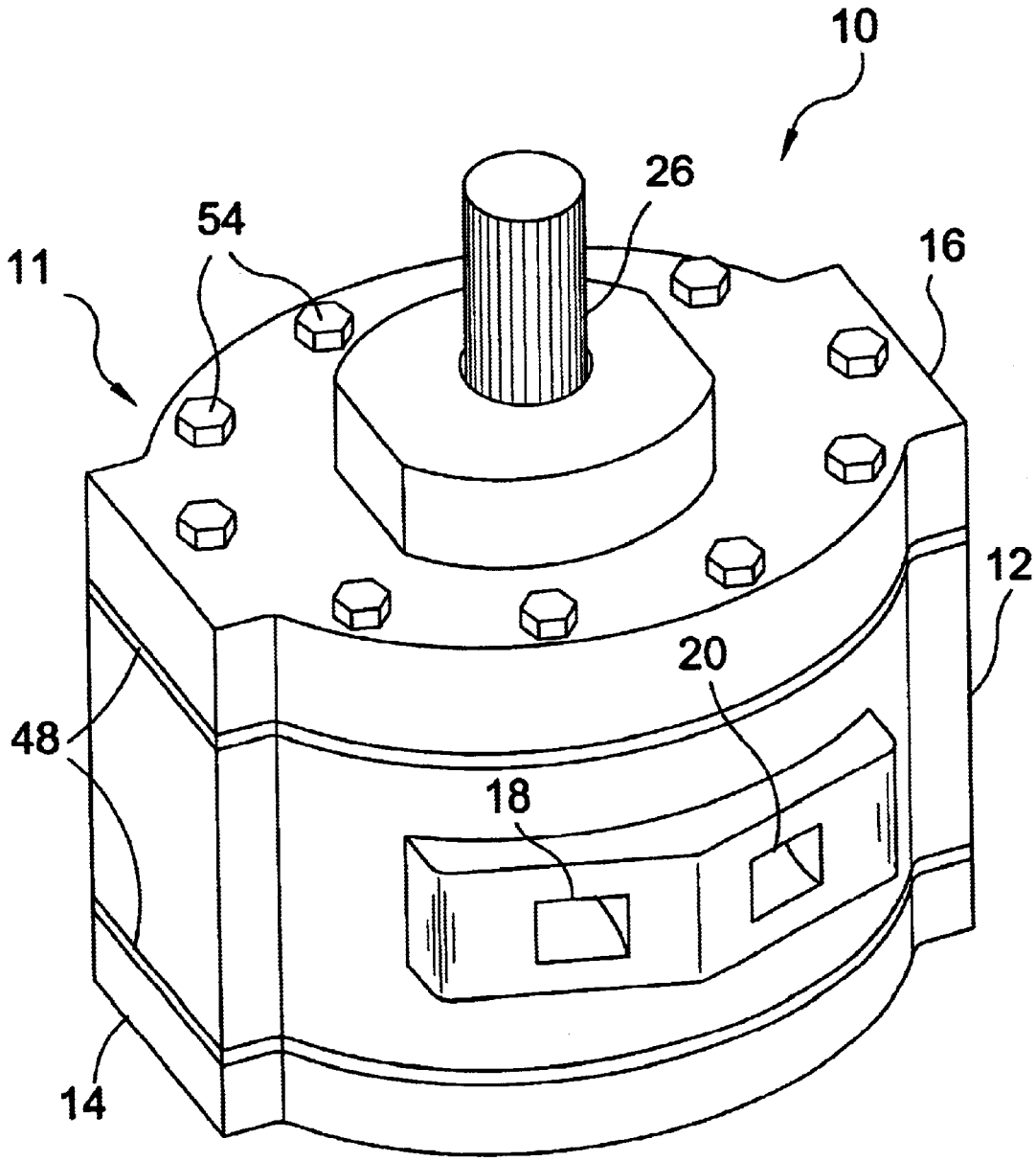
FIG. 1 is a perspective view of the present invention.

FIG. 1 is a perspective view of the present invention 10. The present invention 10 is an elliptical rotary engine 10 contained in a substantially elliptical housing assembly 11 comprising a base 14, a block 12 and a head 16 bolted together to form a sealed housing assembly 11.

Figure 2:
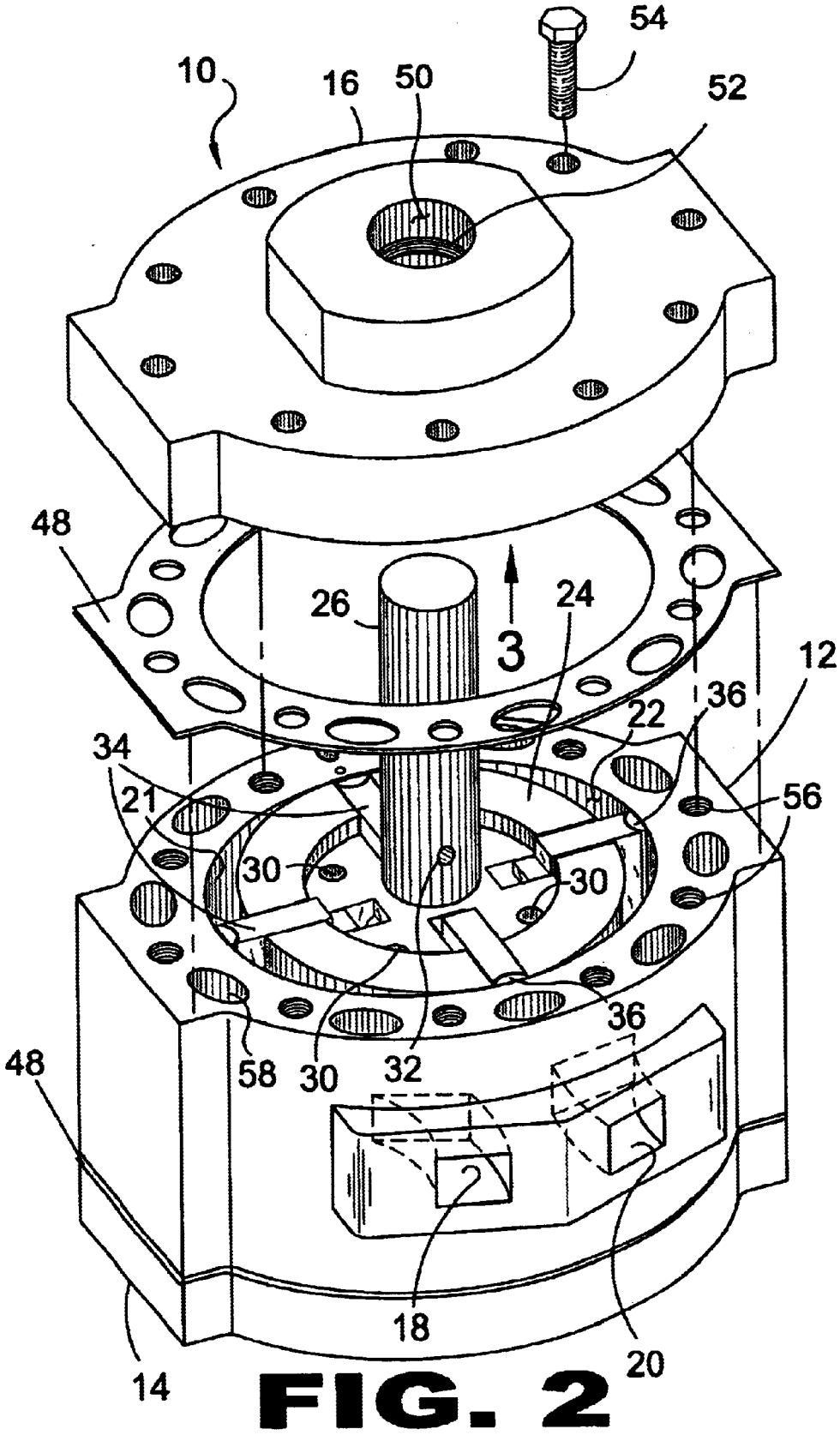
FIG. 2 is a partially exploded view of the present invention.

FIG. 2 is a partially exploded perspective view of the present invention 10. The rotor assembly 23 resides within the elliptical housing assembly 11 and the piston vanes 34 are urged towards the interior wall 21 thereof by elliptical piston vane guides 80, 82 and pressurized oil 74 throughout the rotational movement during normal cycling.

Figure 3:
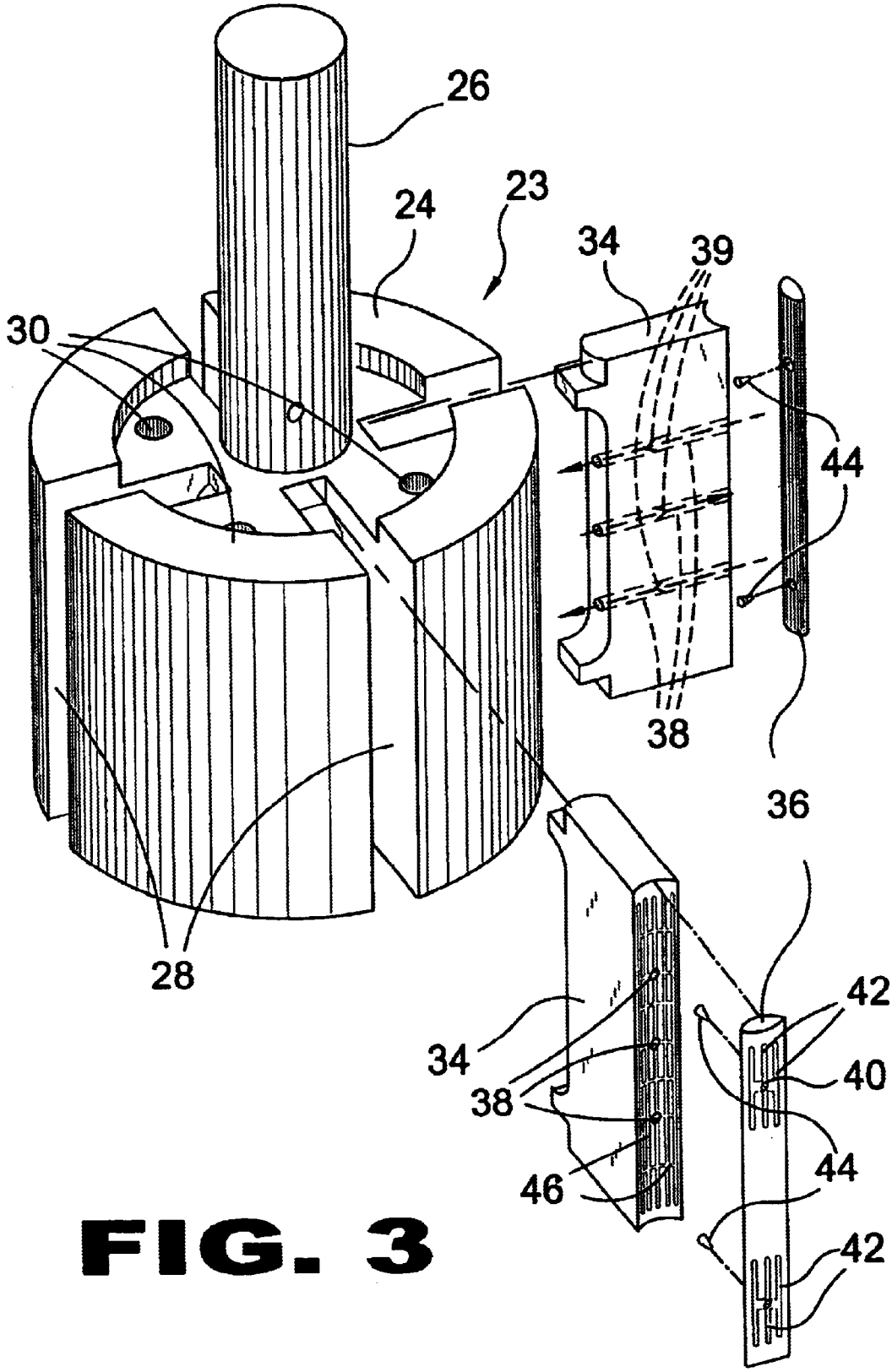
FIG. 3 is an exploded perspective view of the rotor assembly.

FIG. 3 is an exploded view of the rotor assembly 23. Piston vanes 34 reciprocate within the piston vane channels 28 in the rotor 24. Pressurized oil 74 is introduced into the piston vane channels 28 to urge the piston vanes 34 and the associated apex seals 36 against the interior wall 21 of the block 12 and lubricate the contacting surface areas therebetween. Oil channels 42 are etched in the face of the arcuate edge of the piston vanes 34 to ensure the proper distribution of oil 74 thereon. The oil 74 then passes through conical oil conduits 40 extending through the apex seal 36 with the direction of the flow therethrough regulated by one-way check valves in the form of similarly configured wedge-shaped plugs 44 thus insuring a constant flow of oil 74 to the face of the apex seals 36 which are always in contact with the interior wall 21 of the elliptical block 12 as it rotates therein. The distribution of oil 74 over the face of the apex seals 36 is enhanced by oil channels 42 emanating from each oil conduit 40. The vertical extension of the oil channels 42 in the face of the apex seal 36 is less than the vertical height of the intake 18 and exhaust ports 20 of the housing block 12. The surfaces of the apex seals 36 have the same curve as the elliptical wall 21 on its small diameter, so the surfaces of the apex seals 36 touch the elliptical walls 21 completely, and the check valve plugs 44 are pushed inside, in this position oil 74 comes out and lubricates the surface of the apex seal 36 because during the cycle, the middle area of the apex seals. 36 are going to be faced through the intake ports 18 and exhaust port 20.

Figure 4:
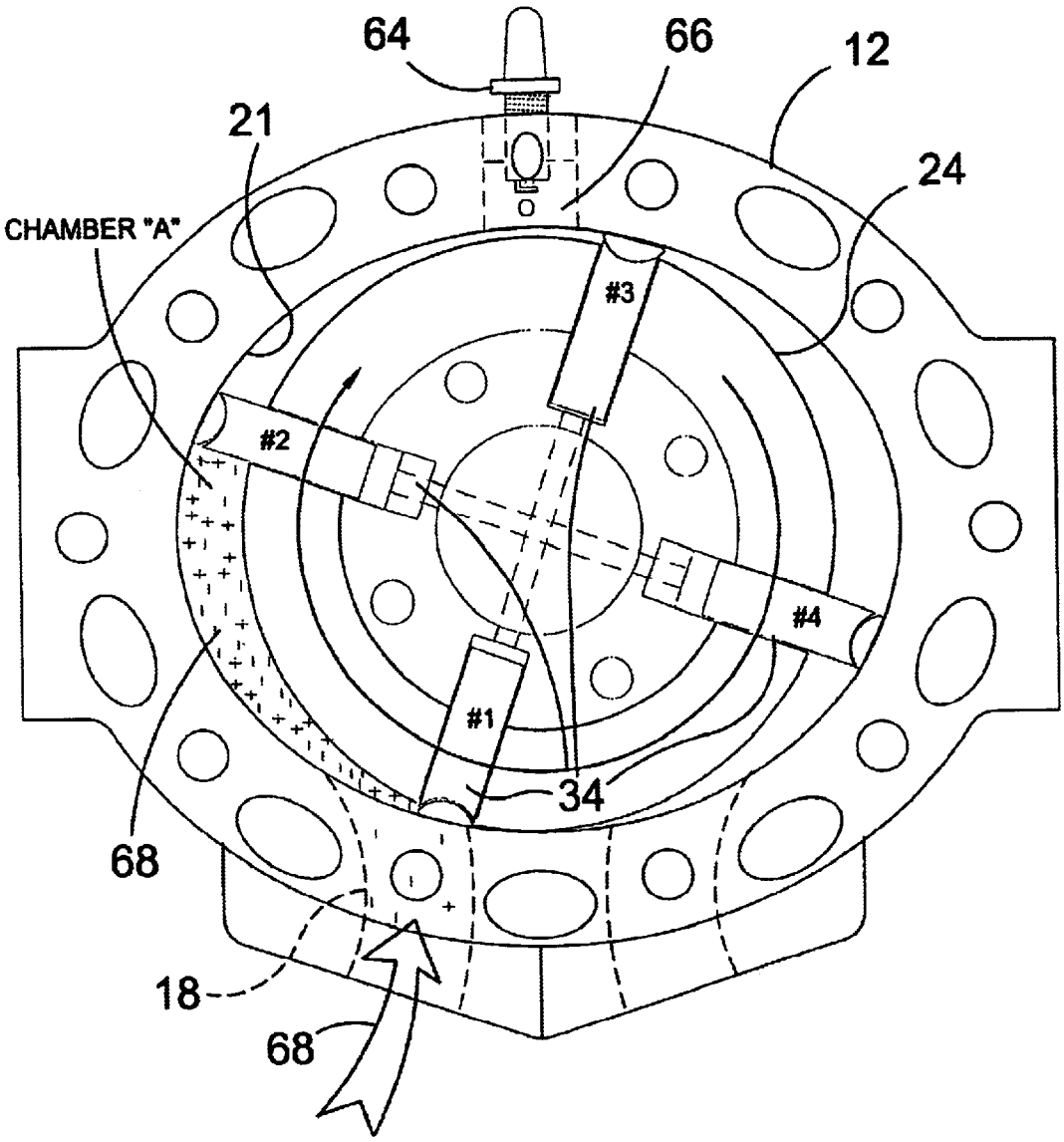
FIG. 4 is a top internal view of the present invention demonstrating the intake phase.

FIG. 4 is a top interior view of the present invention 10 demonstrating the intake phase of cycling chamber "A" 90. For illustrative purposes the cycle of one cycling chamber 90 of the present invention 10 is shown although the other three cycling chambers 90 are simultaneously passing through the phases of their respective cycles. We will follow the action of chamber "A" 90 as defined by the area between piston vanes 1 and 2.

A fuel air mix 68 is introduced into chamber "A" 90 through the intake port 18 where it is sealed therei by the piston vanes 34 that are urged circumferentially toward the elliptical wall 21 of the housing block 12 to press the convex apex seals 36 thereagainst as the rotor 24 turns counterclockwise. The elliptical shape of the piston valve guides 80, 82 and oil pressure provide the bias that maintains the piston vanes 34 against the elliptical wall 21. Apex seals 58 are positioned between the elliptical wall 21 and the arcuate edge of each piston vane 34 and configured to pivot arcuately therein as determined by the variable angle of the elliptical wall 21. The mating surfaces between the apex seal 34 and the piston vane 34 as well as the elliptical wall 21 are lubricated from oil 74 passing through the oil conduits 38 in the piston vane 34.

Figure 5:
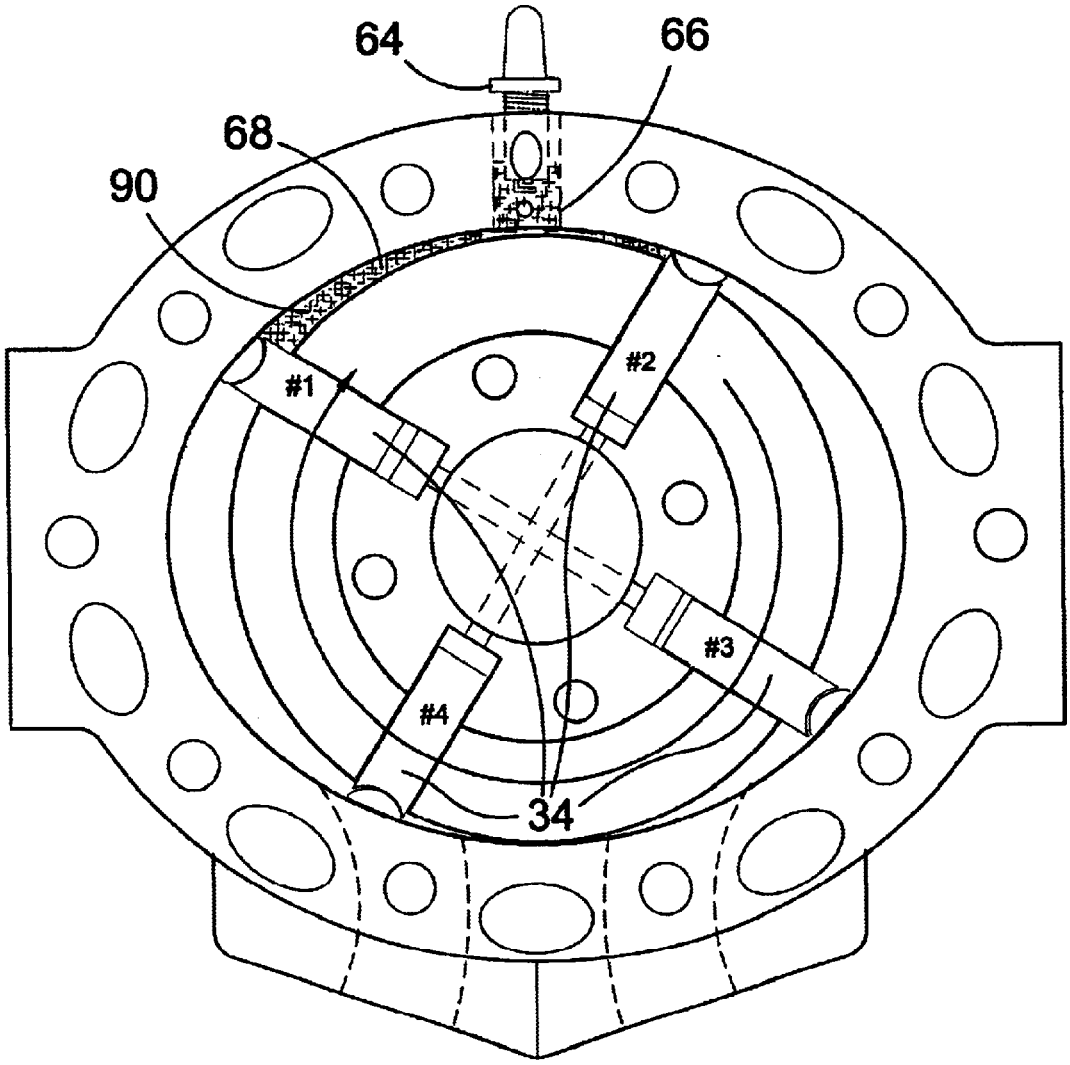
FIG. 5 is a top internal view of the present invention demonstrating the compression phase.

FIG. 5 is a top interior view of the present invention demonstrating the compression phase of chamber "A" 90. During rotation of the rotor 24 the piston vanes 34 extend or retract accordingly within the piston channels 28. The fuel and air mixture 68 in chamber "A" 90 is compressed to a volatile temperature. The apex seals 36 pivot within the lubricated arcuate edge of the piston vane 34 accordingly to adjust to the curvature of the elliptical wall 21 through the rotation thereof.

Figure 6:
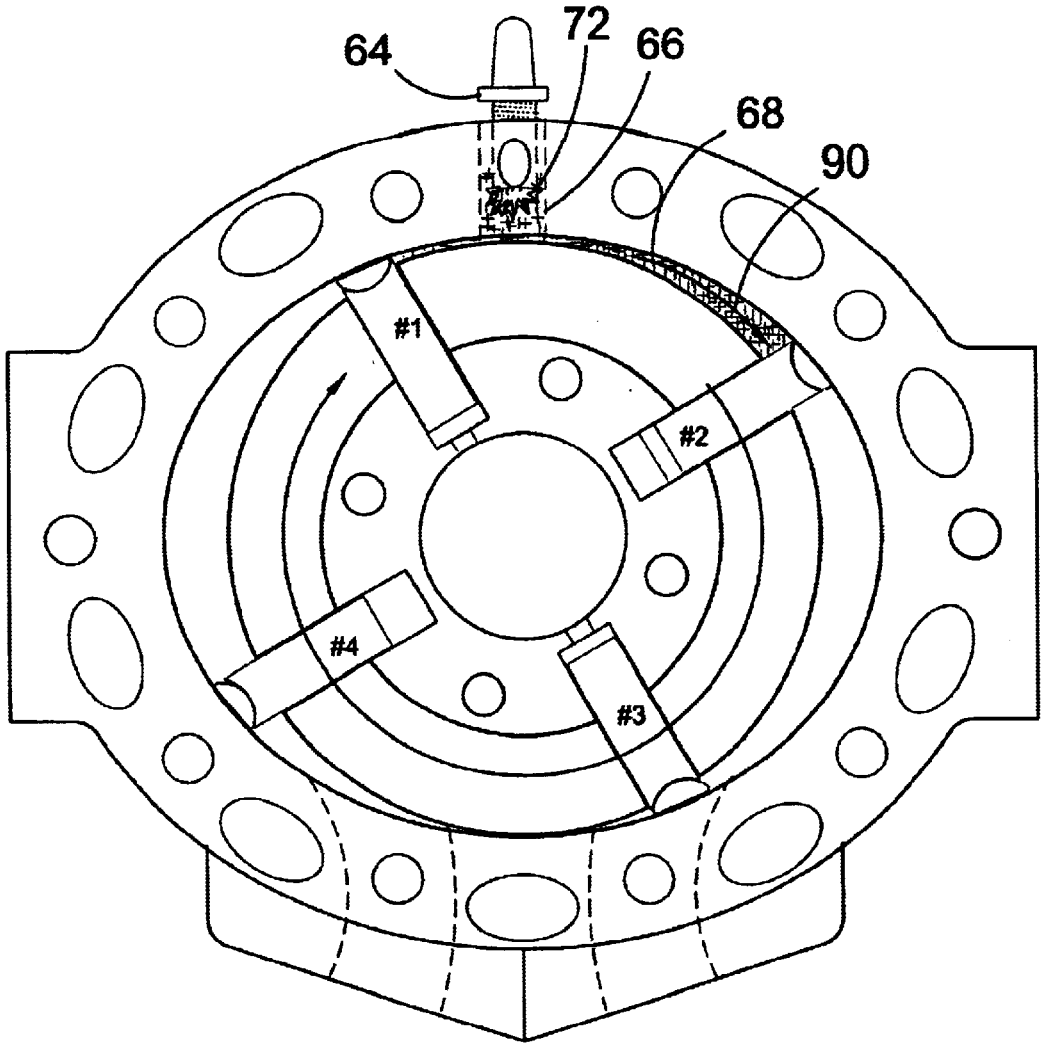
FIG. 6 is a top internal view of the present invention demonstrating the ignition phase.

FIG. 6 is a top interior view of the present invention demonstrating the compression phase of chamber "A" 90. A spark from the spark plug ignites the fuel mixture 68 once it reaches the proper compression. The force of the resulting explosion applies force to the lead piston vane 39 resulting in the counterclockwise rotation of the rotor assembly 23.

Figure 7:
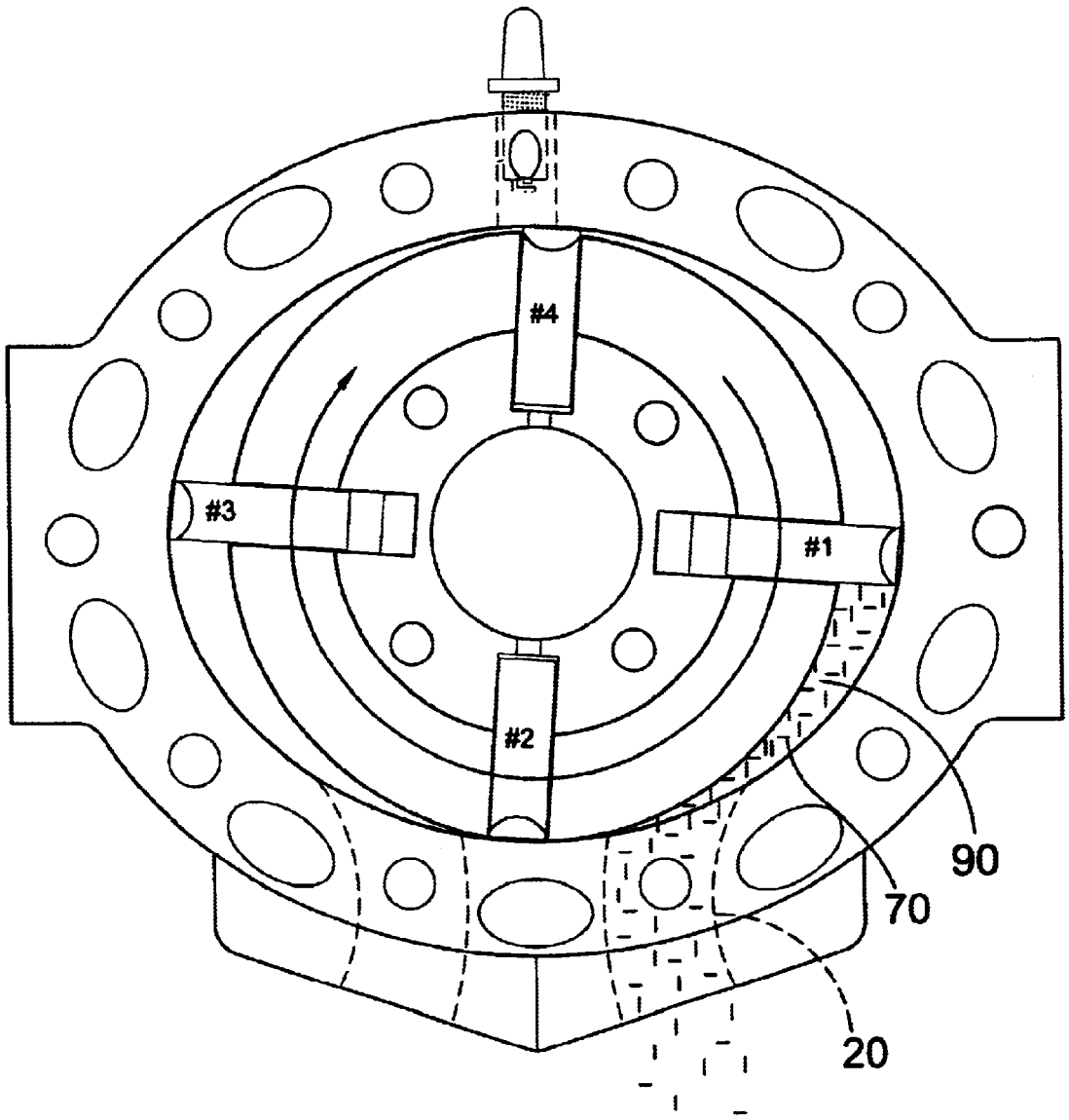
FIG. 7 is a top internal view of the present invention demonstrating the exhaust phase.

FIG. 7 is a top interior view of the present invention demonstrating the exhaust phase of chamber "A" 90. The exhaust gases 70 are expelled through the exhaust port 20 and chamber "A" 90 is ready to accept a fresh mixture from the intake port 18 as the next cycle begins.

Figure 8:
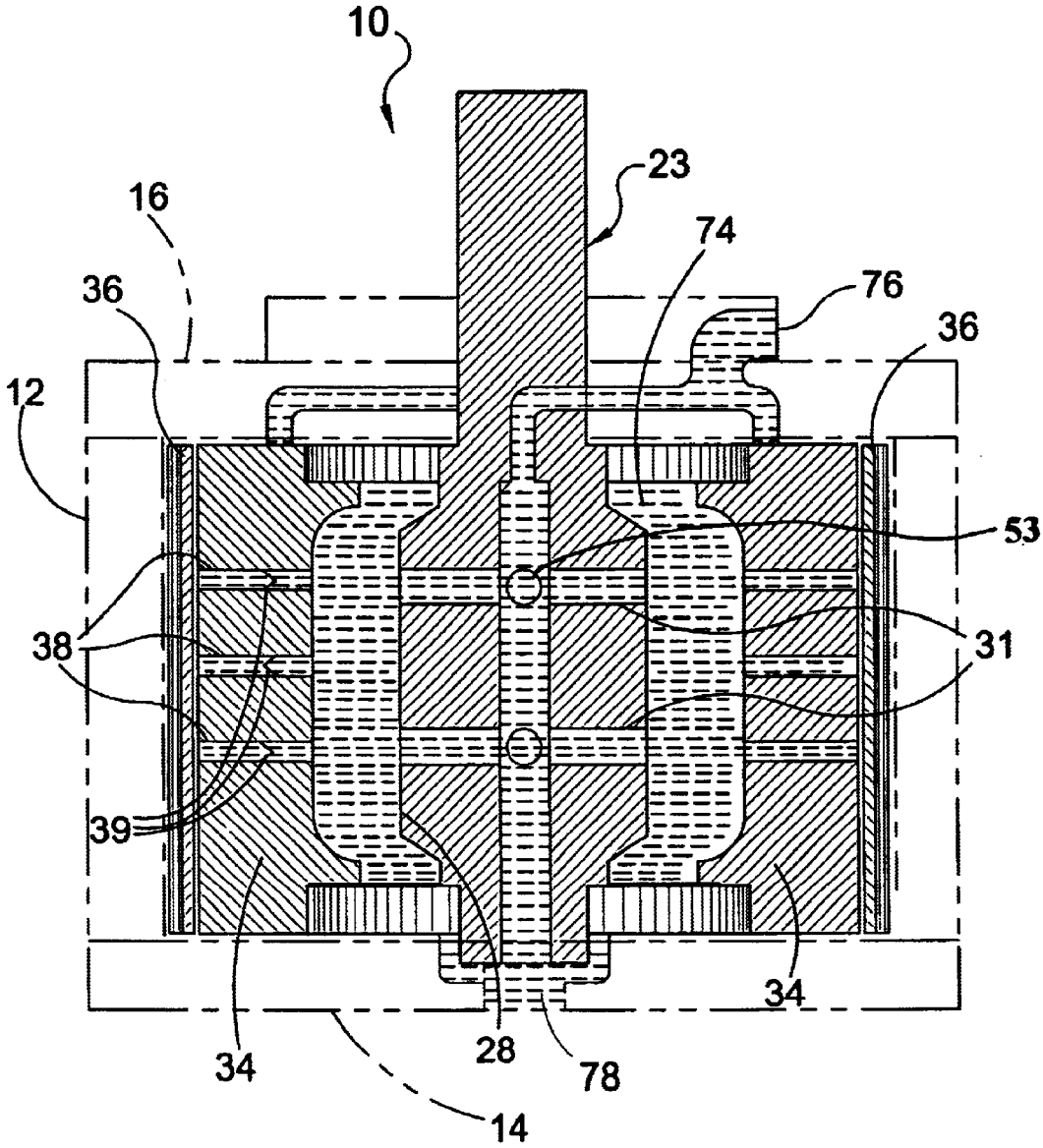
FIG. 8 is a sectional side view of the rotor assembly.

FIG. 8 is a sectional side view of the rotor assembly 23. Pressurized oil 74 is introduced through the oil ports 30 into the piston channel 34 and the oil conduits 38 extending completely through the piston vanes 34 in order to lubricate the surface of the apex seal 36. The oil 74 helps to pressurize the piston channel 34 thereby exerting a force to the piston vane 34 in order to maintain a seal against the elliptical wall 21 of the engine block 12. One-way check valves 39 are installed in the oil conduits 38 to control the flow therethrough.

Figure 9:
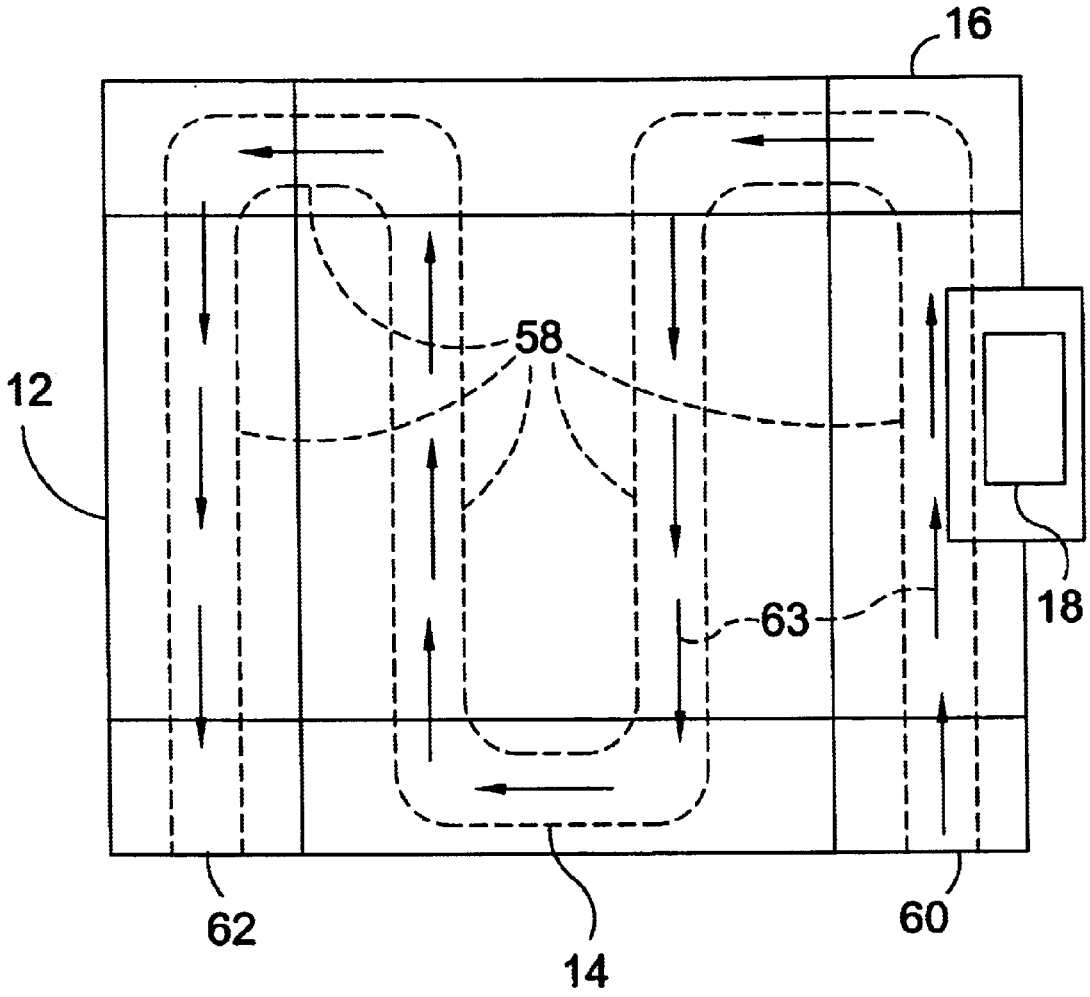
FIG. 9 is a side view of the present invention demonstrating the flow of coolant through the housing assembly.

FIG. 9 is a sectional side view of the present invention 10 demonstrating the flow of coolant 63 through the housing assembly 11. The present invention 10 further includes a cooling system within the housing assembly 11. Coolant 63 is introduced to the housing 11 through a coolant inlet port 14 and flows through a plurality of conduits 58 extending through the base 14, the block 12 and the head 16 until exiting through a coolant outlet 62.

Figure 10:
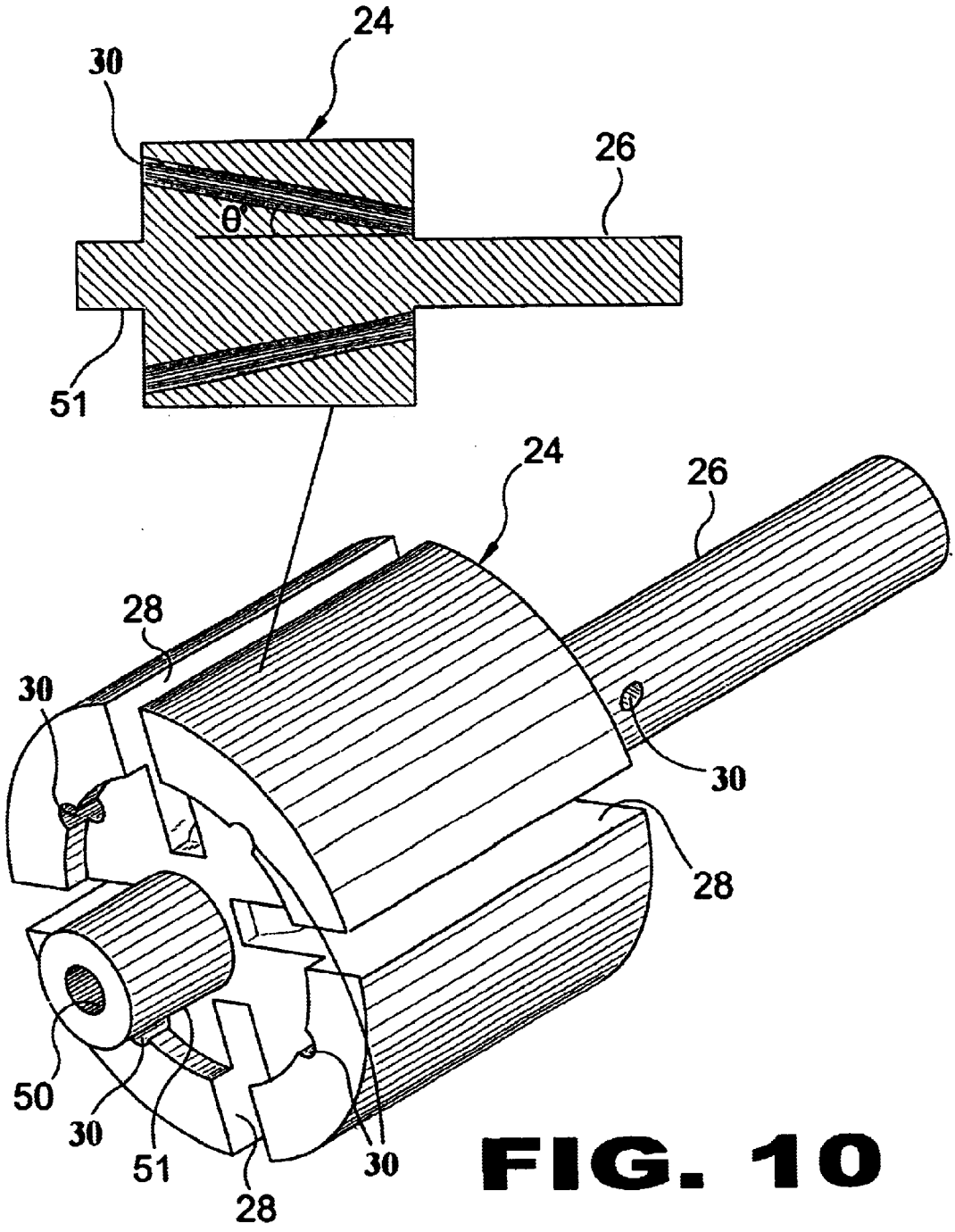
FIG. 10 is a bottom perspective view of the rotor.

FIG. 10 is a bottom perspective view of the rotor assembly 23. The rotor assembly 23 rotates inside the internal elliptical chamber 22. Four oil ports 32 extend longitudinally through the rotor 24 which have an angle from the front side of the rotor (which are close to the rotors center) to the back side of it. The angular properties of the oil ports 32 use centripetal force to create an oil pump effect once rotation of the rotor assembly 23 is initiated.

FIG. 11 is a bottom perspective view of the present invention 10. The present invention 10 is an elliptical rotary engine 10 contained in a substantially elliptical housing assembly 11 comprising a base 14, a block 12 and a head 16 bolted together to form a sealed housing member. A spark plug 64 is removably inserted in the housing block 12 to provide a means for spark ignition. A coolant inlet 60 and a coolant outlet 62 in the base 14 to provide for the introduction and removal of coolant 63 to the housing assembly 11. An oil outlet port (not shown) may be centrally positioned for removing oil 74 from the rotor assembly 23.

FIG. 12 is a partially exploded rear perspective view of the present invention 10. This view depicts the position of the oil intake port 52 and spark plug 64 as they appear on the housing block 12 and head 16.

FIG. 13 is a top perspective view of the housing base 14. Shown are the oil ports 88 and coolant ports 58 that allow for fluid transport through the base 14 of the housing assembly 11 to lubricate and provide thermal stability to the present invention 10. Coolant 63 is introduced to the present invention 10 through the coolant inlet 60 on the bottom of the housing base 14. The coolant 63 then progresses through a coolant conduit 58 in the base 14, into a coolant conduit 58 in the block 12 and into coolant conduits 58 in the housing head 16. The coolant 63 is transferred from one coolant conduit 58 to an adjacent one where it returns to coolant conduits 58 in the base 14 through the corresponding coolant conduit 58 in the block 12. The coolant 63 continues this serpentine circulation throughout the housing assembly 11 until reaching the coolant outlet 62 for preparation for recirculation.

Oil 74 works as a coolant for the rotor assembly 23 and other internal parts of the elliptical rotary engine 10. There are gaskets 48 placed in the head 16 and the base 14 which are elliptically shaped to prevent them from turning around themselves. The elliptical shape also provides a lubrication system from small diameter of elliptical gaskets 48.

FIG. 14 is a bottom perspective view of the housing head 16. Shown are the oil outlet ports 76 and coolant ports 58 that allow for fluid transport through the head 16 of the housing assembly 11 to lubricate and provide thermal stability to the present invention 10. After the rotor 24 turns a little more there will be a small gap between the surface of the apex seal 36 and the curve of the elliptical wall 21 so the check valve plugs 44 come out to prevent oil 74 from overflowing in the gap and flow into the intake and exhaust ports.

What is claimed as new and desired to be protected by Letters Patent is set forth in the appended claims:

1. An elliptical rotary engine comprising:

a) an elliptically housing assembly including:

i) a substantially hollow block member with an interior wall defining an elliptical interior chamber including an air fuel intake port and a exhaust port;

ii) a base member having an oil intake port, a coolant inlet port, a coolant outlet port and a cam-like elliptically shaped piston vane guide;

iii) a head member including an oil intake port and a cam-like elliptical shaped piston vane guide having a centrally disposed power shaft recess;

iv) means for fastening said head member and said base member to said block member;

v) means for transporting coolant introduced from said coolant intake port throughout the internal structures of said base member and back to said coolant outlet port, said block member and said head member to provide thermal stability to said housing assembly during operation;

vi) elliptical for sealing the surface contact points between said block member and said base member and between said block member and said head member; and vii) means for introducing a spark into said interior chamber of said blocks;

b) a rotor assembly including:

i) a substantially cylindrical rotor having a first end and a second end;

ii) a power extending from said first end of said rotor;

iii) a retaining shaft extending from said second end of said rotor;

iv) a plurality of equidistantly spaced piston vane channels radially extending through the entire length of said rotor;

v) a plurality of longitudinally disposed piston vanes having a first medially disposed end and a second peripheral end sized and configured similar to the piston vane channels so as to radially slide therein, said second end having concave properties;

vi) a plurality of longitudinally disposed convex apex seals, each of the convex apex seals having a first convex side and a second convex side, wherein said first convex side has a curvilinear radius substantially similar to that of said second convex side of each said piston vane; and vii) means for lubricating and cooling the aforementioned components of said rotor assembly.

2. The elliptical rotary engine as recited in claim 1, wherein said rotor assembly resides within said internal chamber of said housing with said retaining shaft rotatably inserted within said central recess of said elliptical vane guide of said base member and said power shaft extending though said central recess of said head.

3. The elliptical rotary engine as recited in claim 1, wherein said piston vanes reside within said piston vane channels, with said convex apex seals disposed between said piston vanes and said interior wall of said housing block in such a manner that the rotation of said rotor assembly causes said elliptical piston vane guides to urge said piston vanes and the respective convex apex seals radially outwards towards said interior wall as the piston vanes pass through the gap between said rotor and said interior wall until reaching the greatest point of separation thereof, at which point said interior wall urges said piston vanes and the respective convex apex seals back into said piston vane channels until said piston vanes are fully retracted thereby effectively maintaining all of said convex apex seals against said interior wall throughout the entire cycle creating four independent cycling chambers as defined by the area between the extended piston vanes, said rotor and said interior wall.

4. The elliptical rotary engine as recited in claim 1, wherein said spark introduction means comprises a recess forming a combustion chamber for retaining a spark plug, said combustion chamber located opposite said air fuel intake port and said exhaust port on the portion of said internal elliptical chamber having the smallest diameter.

5. The elliptical rotary engine as recited in claim 1, wherein a fuel air mix is introduced through said air fuel intake port into the aligned cycling chamber during the intake phase thereof which continues until the waling piston vane of said camber rotates beyond said air fuel intake port whereupon the lead piston vane begins to retract because of the decreasing gap between said elliptical wall and said rotor thus initiating the compression phase during which the air fuel mix compressed to a heated, volatile state until aligned with said combustion chamber where a spark is ignited by the spark plug causing the air fuel mix to explode and the expanding gases to propel the lead vane and continue to advance said rotor, the rotation of the rotor continues and the exhaust gases are expelled when said chamber is aligned with said exhaust port, meanwhile all cycling chambers are going through their respective cycles simultaneously.

6. The elliptical rotary engine as recited in claim 1, wherein said means for lubricating said rotor assembly comprises a combination of oil ports, oil conduits and oil channels extending through all of the components thereof and communicating with one another to allow for the transport and delivery of oil to all frictionally mated moving surfaces.

7. The elliptical rotary engine as recited in claim 1, wherein said piston vanes further include a plurality of oil conduits traversing therethrough, each of said oil conduits having a one-way check valve to provide for the controlled transmission of oil between each of said piston vane channels and each of said apex seals.

8. The elliptical rotary engine as recited in claim 1, wherein said convex apex seals include a plurality of oil conduits extending therethrough, wherein an opening of each of said oil conduits on said first side of said apex seal is substantially conical and includes a smaller, similarly-shaped check-valve plug therein for controlling the directional flow of oil therethrough.

9. The elliptical rotary engine as recited in claim 1, wherein said housing assembly further comprises:

a) a coolant inlet port in said housing base;

b) a coolant outlet port in said housing base;

c) a plurality of coolant conduits in said housing base, said housing block and said housing head aligned and configured to form a single, enclosed, serpentine channel leading from said coolant inlet port through said housing assembly and terminating at said coolant outlet port; and d) coolant for flowing through said coolant conduits to maintain thermal regulation of said housing assembly during operation.

* * * * *